US010292438B2

(12) United States Patent
Fortenbacher

(10) Patent No.: US 10,292,438 B2
(45) Date of Patent: May 21, 2019

(54) HEATED GARMENTS

(71) Applicant: David Fortenbacher, Muskegon, MI (US)

(72) Inventor: David Fortenbacher, Muskegon, MI (US)

( * ) Notice: Subject to any disclaimer, the term of this patent is extended or adjusted under 35 U.S.C. 154(b) by 79 days.

(21) Appl. No.: 15/295,377

(22) Filed: Oct. 17, 2016

(65) Prior Publication Data

US 2018/0103694 A1 Apr. 19, 2018

(51) Int. Cl.

| | |
|---|---|
| ***A41D 13/005*** | (2006.01) |
| ***D01F 9/12*** | (2006.01) |
| ***H05B 1/02*** | (2006.01) |
| ***H05B 3/14*** | (2006.01) |
| ***H05B 3/34*** | (2006.01) |

(52) U.S. Cl.

CPC ..... *A41D 13/0051* (2013.01); *H05B 1/0272* (2013.01); *H05B 3/145* (2013.01); *H05B 3/34* (2013.01); *D10B 2501/00* (2013.01); *H05B 2203/036* (2013.01); *H05B 2214/04* (2013.01)

(58) Field of Classification Search

None

See application file for complete search history.

(56) References Cited

U.S. PATENT DOCUMENTS 5,032,705 A * 7/1991 Batcheller ..... A41D 13/0051 219/211
D772,537 S * 11/2016 Lavin, Jr. ..... D2/853
9,603,194 B2 * 3/2017 Peng ..... H05B 1/0272
2001/0027244 A1 * 10/2001 Branum ..... C08G 63/668 528/300
2002/0179564 A1 * 12/2002 Geobegan ..... B82Y 30/00 216/7
2008/0083721 A1 * 4/2008 Kaiserman ..... A43B 3/0005 219/211
2008/0083740 A1 * 4/2008 Kaiserman ..... A43B 7/04 219/520

(Continued)

*Primary Examiner* — Ibrahime A Abraham
*Assistant Examiner* — Gyounghyun Bae
(74) *Attorney, Agent, or Firm* — James E. Shultz, Jr.

(57) ABSTRACT

Electrically heated, cold weather garments, are provided that include carbon nanotube heating elements. A garment may include a lightweight, stretchable, form-fitting fabric for covering portions of the body of a wearer of the garment; a plurality of flexible, electrical heating element stitched to the fabric by sewing; an electronic controller for controlling current flowing through each of the heating elements in a pulse-width modulated fashion, to thereby independently control the heat generated by each heating element; a plurality of potentiometers for controlling the level of power supplied to each heating wire; and a master power level potentiometer for controlling the power supplied to each of the heating wires in a uniform and simultaneous fashion. A controller may utilize a combination of analog and digital-like signals to control in a pulse-width modulated fashion the current flow through the heating elements. Alternatively, a controller may include a microprocessor which is operable to sense changes in the temperature of the heating wires themselves, and to regulate automatically and independently the power supplied to each of the heating elements.

20 Claims, 3 Drawing Sheets

(56) References Cited

U.S. PATENT DOCUMENTS

| | | | | |
|---|---|---|---|---|
| 2008/0170982 | A1* | 7/2008 | Zhang | B82Y 10/00 423/447.3 |
| 2010/0021683 | A1* | 1/2010 | Junghans | H05B 3/34 428/116 |
| 2010/0297441 | A1* | 11/2010 | Zhu | B82Y 30/00 428/370 |
| 2011/0108545 | A1* | 5/2011 | Wang | H05B 3/283 219/546 |
| 2012/0022620 | A1* | 1/2012 | Khodak | A61F 7/007 607/96 |
| 2012/0292304 | A1* | 11/2012 | Burchard | G05D 23/19 219/386 |
| 2013/0101495 | A1* | 4/2013 | Peterson | B82Y 40/00 423/447.2 |
| 2014/0353300 | A1* | 12/2014 | Swiatek | H05B 1/0272 219/211 |
| 2015/0152852 | A1* | 6/2015 | Li | H02N 11/006 60/528 |
| 2016/0165970 | A1* | 6/2016 | Jost | H01G 11/24 219/211 |
| 2018/0127901 | A1* | 5/2018 | Mo | D03D 15/00 |

* cited by examiner

HEATED GARMENTS

TECHNICAL FIELD

The present disclosure relates to heated garments (e.g., shirts, pants, socks, shoes, boots, gloves, hats, scarves, face masks, coats, overalls, underwear, helmets, etc.). More particularly, the present disclosure relates to heated garments that include carbon nanotube heating elements.

BACKGROUND

Electrically heated garments, or portions thereof, are helpful in combating the effects of cold temperatures on a person subjected to prolonged exposure to the cold. More specifically, a heated garment can prove helpful to persons such as sportsmen, farmers, construction workers, public officials, military personnel, etc., who frequently are exposed to cold weather for prolonged periods of time.

Problems with prior art electronic control systems for electrically heated garments have existed with respect to the ability to heat a plurality of discrete heating zones of the garment independently. Heating different zones individually with a high degree of control is desirable because of the varying rate at which different parts of the body lose heat. The extremities, i.e., hands, feet and head, for example, suffer from a greater heat loss than the torso. In addition, physical activities of the wearer of the garment can cause different parts of his body to generate heat at varying levels. A system which applies the same level of heat to all areas of the garment can therefore produce temperature levels within the garment that are uncomfortable to the wearer.

Prior art electronic control systems, to be able to control the heat applied to various zones of the garment independently, typically require an independent, user actuatable switch for each zone to enable or interrupt the current flowing to its associated heating element or elements. In these systems the control of the wearer over the amount of heat generated by the various heating elements of the suit is quite limited, the heating elements are either fully on or fully off, thereby generating either maximum heat or no heat at all. In some prior art systems, attempts have been made to provide variable control over the heat generated by each heating element by using switches to selectively connect a power source to a plurality of heating elements having different heat generating capabilities or characteristics. In this manner some control is allowed over the amount of heat generated for a particular zone of the garment, but still only in fixed steps.

Another drawback of many prior art heated garments is the fabric used for the garment itself. Ideally, the fabric should be light in weight and not bulky to minimize the loss of flexibility during physical activities of the wearer. The fabric itself should also have excellent insulating capabilities, be stretchable, and be capable of rapidly absorbing and evaporating moisture and perspiration from the skin of the wearer. Many prior art heated garments suffer from a lack of one or more of these features.

In view of the above, heated garments are needed that include carbon nanotubes.

SUMMARY

A heated garment may include a fabric. The heated garment may also include a plurality of heating elements, that include carbon nanotubes, proximate the fabric. The heated garment may further include an electronic controller connecting a controller for controlling electrical current flowing through the plurality of heating elements.

In another embodiment, an electrically heated garment may include a fabric incorporating carbon nanotubes for generating heat in response to a current flow therethrough, and for distributing heat throughout the fabric. The garment may also include a controller for controlling in pulse width modulated fashion the current flow through the carbon nanotubes, the controller means further being secured to a portion of the garment and power level selection for providing manual control over the controller. The garment may further include a flexible wiring harness having first and second ends, the first end being connectable to the controller and an electrical connector securely mounted to a portion of the fabric means for removably connecting the second end of the wiring harness with the conductor.

In a further embodiment, an electrically heated wearable garment may include a fabric including carbon nanotubes. The garment may further include a controller connection for connecting a controller for controlling electric current flowing through the carbon nanotubes.

DETAIL DESCRIPTION

Figure 1:
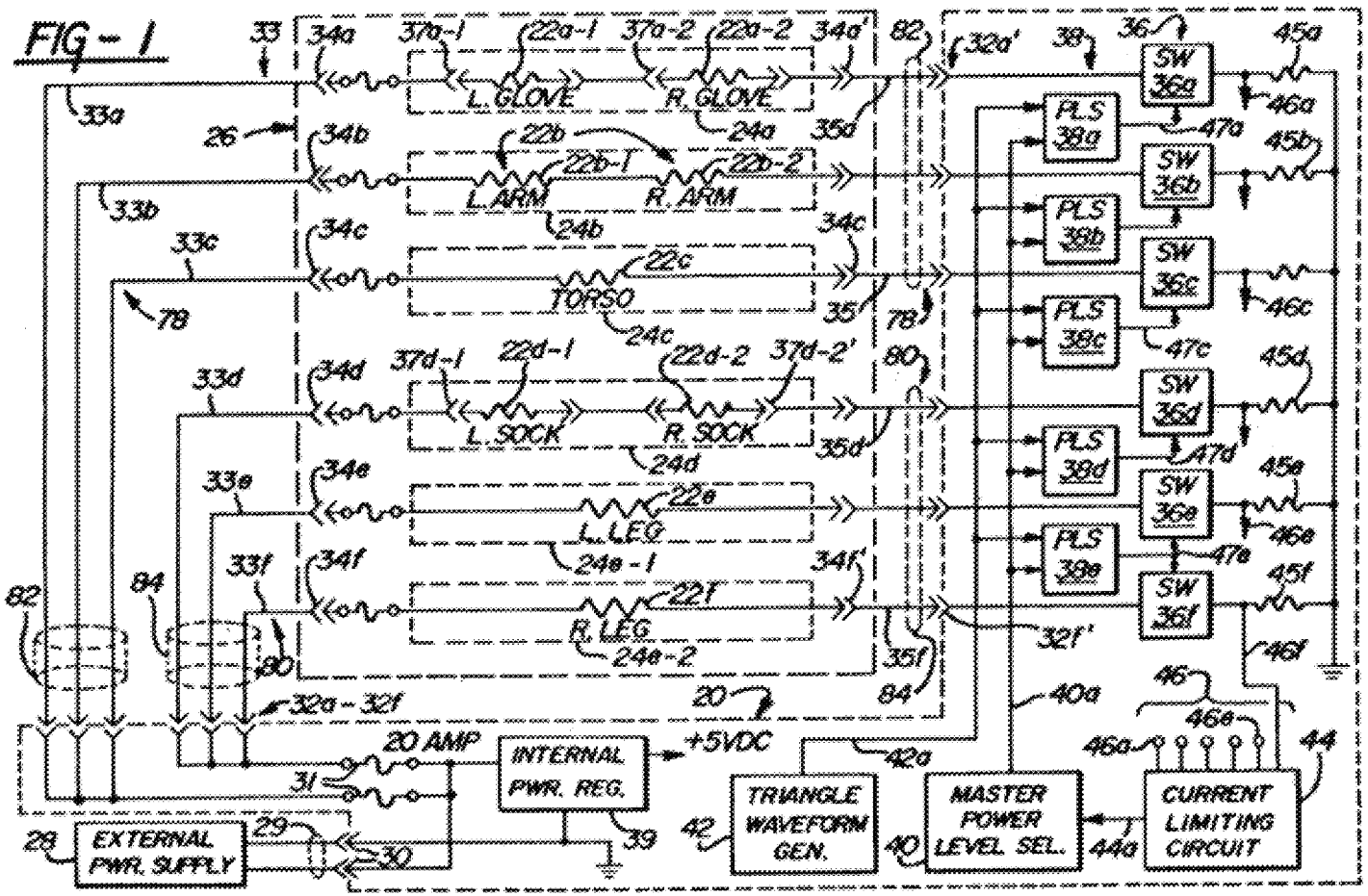
FIG. 1 depicts an example controller.

A nanoparticle composite may include a structure as disclosed, for example, in any one of U.S. Pat. No. 9,377,449, entitled Nanocomposite oil sensors for downhole hydrocarbon detection; U.S. Pat. No. 9,372,151, entitled Cross antennas for surface-enhanced infrared absorption (SERA) spectroscopy of chemical moieties; U.S. Pat. No. 9,358,730, entitled Dynamic strain hardening in polymer nanocomposites; U.S. Pat. No. 9,356,151, entitled Fabrication of graphene nanoribbons and nanowires using a meniscus as an etch mask; U.S. Pat. No. 9,340,894, entitled Anode battery materials and methods of making the same; U.S. Pat. No. 9,321,021, entitled Converting nanoparticles in oil to aqueous suspensions; U.S. Pat. No. 9,312,540, entitled Conformal coating on nanostructured electrode materials for three-dimensional applications; U.S. Pat. No. 9,312,078, entitled Patterned graphite oxide films and methods to make and use same; U.S. Pat. No. 9,290,665, entitled Coated fullerenes, compositions and dielectrics made therefrom; U.S. Pat. No. 9,283,511, entitled Composite materials for reversible CO.sub.2 capture; U.S. Pat. No. 9,260,570, entitled Compression induced stiffening and alignment of liquid crystal elastomers; U.S. Pat. No. 9,255,853, entitled Non-contact strain sensing of objects by use of single-walled carbon nanotubes; U.S. Pat. No. 9,249,023, entitled Liquid crystals from single-walled carbon nanotube polyelectrolytes and their use for making various materials; U.S. Pat. No. 9,228,009, entitled Multi-hierarchical self-assembly of a collagen mimetic peptide; U.S. Pat. No. 9,222,665, entitled Waste remediation; U.S. Pat. No. 9,202,952, entitled Plasmon induced hot carrier device, method for using the same, and method for manufacturing the same; U.S. Pat. No. 9,129,720, entitled Synthesis of uniform nanoparticle shapes with high selectivity; U.S. Pat. No. 9,106,342, entitled Device and method for modulating transmission of terahertz waves; U.S. Pat. No. 9,096,437, entitled Growth of graphene films from non-gaseous carbon sources; U.S. Pat. No. 9,095,876, entitled Immobilized carbon nanotubes on various surfaces; U.S. Pat. No. 9,068,109, entitled Nano-encapsulated triggered-release viscosity breaker; U.S. Pat. No. 9,067,791, entitled Embedded arrays of vertically aligned carbon nanotube carpets and methods for making them; U.S. Pat. No. 9,061,268, entitled Synthesis of ultrasmall metal oxide nanoparticles; U.S. Pat. No. 9,034,085, entitled Aliphatic amine based nanocarbons for the absorption of carbon dioxide; U.S. Pat. No. 9,032,731, entitled Cooling systems and hybrid A/C systems using an electromagnetic radiation-absorbing complex; U.S. Pat. No. 9,005,460, entitled Layer-by-layer removal of grapheme; U.S. Pat. No. 8,992,881, entitled Graphene nanoribbons prepared from carbon nanotubes via alkali metal exposure; U.S. Pat. No. 8,986,942, entitled Carbon nanotube based imaging agents; U.S. Pat. No. 8,958,362, entitled Method and system for wirelessly transmitting data; U.S. Pat. No. 8,956,440, entitled High-yield synthesis of gold nanorods with optical absorption at wavelengths greater than 1000 nm using hydroquinone; U.S. Pat. No. 8,916,606, entitled Therapeutic compositions and methods for targeted delivery of active agents; U.S. Pat. No. 8,906,984, entitled Synthesis of metal and metal oxide nanoparticle-embedded siloxane composites; U.S. Pat. No. 8,816,042, entitled Polyamide composites having flexible spacers; U.S. Pat. No. 8,815,231, entitled Systems and methods for magnetic guidance and patterning of materials; U.S. Pat. No. 8,809,979, entitled Functionalized carbon nanotube-polymer composites and interactions with radiation; U.S. Pat. No. 8,784,866, entitled Water-soluble carbon nanotube compositions for drug delivery and medicinal applications; U.S. Pat. No. 8,732,468, entitled Protecting hardware circuit design by secret sharing; U.S. Pat. No. 8,709,373, entitled Strongly bound carbon nanotube arrays directly grown on substrates and methods for production thereof; U.S. Pat. No. 8,703,090, entitled Methods for preparation of graphene nanoribbons from carbon nanotubes and compositions, thin films and devices derived therefrom; U.S. Pat. No. 8,679,442, entitled Fullerene compositions and methods for photochemical purification; U.S. Pat. No. 8,663,690, entitled Method for nanoencapsulation; U.S. Pat. No. 8,663,495, entitled Gelled nanotube-containing heat transfer medium; U.S. Pat. No. 8,636,830, entitled Aliphatic amine based nanocarbons for the absorption of carbon dioxide; U.S. Pat. No. 8,596,466, entitled Production of single-walled carbon nanotube grids; U.S. Pat. No. 8,591,854, entitled Methods for solubilizing and separating large fullerenes; U.S. Pat. No. 8,575,548, entitled Analyzing the transport of plasmonic particles through mineral formations; U.S. Pat. No. 8,562,935, entitled Amplification of carbon nanotubes via seeded-growth methods; U.S. Pat. No. 8,541,322, entitled Sidewall functionalization of carbon nanotubes with organosilanes for polymer composites; U.S. Pat. No. 8,540,959, entitled Bulk cutting of carbon nanotubes using electron beam irradiation; U.S. Pat. No. 8,460,428, entitled Single-crystalline metal nanorings and methods for synthesis thereof; U.S. Pat. No. 8,449,854, entitled Method for preparation of new superhard B-C-N material and material made therefrom; U.S. Pat. No. 8,440,467, entitled Electronic switching, memory, and sensor devices from a discontinuous graphene and/or graphite carbon layer on dielectric materials; U.S. Pat. No. 8,420,717, entitled Polyol functionalized water soluble carbon nanostructures; U.S. Pat. No. 8,398,950, entitled Condensation polymers having covalently bound carbon nanotubes; U.S. Pat. No. 8,395,901, entitled Vertically-stacked electronic devices having conductive carbon films; U.S. Pat. No. 8,394,664, entitled Electrical device fabrication from nanotube formations; U.S. Pat. No. 8,390,326, entitled Method for fabrication of a semiconductor element and structure thereof; U.S. Pat. No. 8,362,559, entitled Hybrid molecular electronic devices containing molecule-functionalized surfaces for switching, memory, and sensor applications and methods for fabricating same; U.S. Pat. No. 8,362,295, entitled Graphene compositions and methods for production thereof; U.S. Pat. No. 8,361,349, entitled Fabrication of light emitting film coated fullerenes and their application for in-vivo light emission; U.S. Pat. No. 8,337,809, entitled Charge-assembled capsules for phototherapy; U.S. Pat. No. 8,310,134, entitled Composition for energy generator, storage, and strain sensor and methods of use thereof; U.S. Pat. No. 8,269,501, entitled Methods for magnetic imaging of geological structures; U.S. Pat. No. 8,236,491, entitled Protein fragment complementation assay for thermophiles; U.S. Pat. No. 8,223,330, entitled Nanostructures and lithographic method for producing highly sensitive substrates for surface-enhanced spectroscopy; U.S. Pat. No. 8,217,137, entitled Fullerene-based amino acids; U.S. Pat. No. 8,201,517, entitled Method for low temperature growth of inorganic materials from solution using catalyzed growth and re-growth; U.S. Pat. No. 8,187,703, entitled Fiber-reinforced polymer composites containing functionalized carbon nanotubes; U.S. Pat. No. 8,183,180, entitled Graphene compositions and drilling fluids derived therefrom; U.S. Pat. No. 8,178,202, entitled Nonconcentric nano shells with offset core in relation to shell and method of using the same; U.S. Pat. No. 8,158,203, entitled Methods of attaching or grafting carbon nanotubes to silicon surfaces and composite structures derived therefrom; U.S. Pat. No. 8,128,901, entitled Facile purification of carbon nanotubes with liquid bromine at room temperature; U.S. Pat. No. 8,124,503, entitled Carbon nanotube diameter selection by pretreatment of metal catalysts on surfaces; U.S. Pat. No. 8,106,430, entitled Preparation of thin film transistors (TFTs) or radio frequency identification (RFID) tags or other printable electronics using ink-jet printer and carbon nanotube inks; U.S. Pat. No. 8,097,141, entitled Flow dielectrophoretic separation of single wall carbon nanotubes; U.S. Pat. No. 8,092,774, entitled Nanotube-amino acids and methods for preparing same; U.S. Pat. No. 8,089,628, entitled Pulsed-multiline excitation for color-blind fluorescence detection; U.S. Pat. No. 8,080,199, entitled Interaction of microwaves with carbon nanotubes to facilitate modification; U.S. Pat. No. 8,062,748, entitled Methods for preparing carbon nanotube/polymer composites using free radical precursors; U.S. Pat. No. 8,062,702, entitled Coated fullerenes, composites and dielectrics made therefrom; U.S. Pat. No. 8,058,613, entitled Micromechanical devices for materials characterization; U.S. Pat. No. 8,045,152, entitled All optical nanoscale sensor; U.S. Pat. No. 8,007,829, entitled Method to fabricate inhomogeneous particles; U.S. Pat. No. 8,003,215, entitled Fluorinated nanodiamond as a precursor for solid substrate surface coating using wet chemistry; U.S. Pat. No. 7,998,271, entitled Solvents and new method for the synthesis of CdSe semiconductor nanocrystals; U.S. Pat. No. 7,976,816, entitled Method for functionalizating carbon naontubes utilizing peroxides; U.S. Pat. No. 7,973,559, entitled Method for fabrication of a semiconductor element and structure thereof; U.S. Pat. No. 7,959,779, entitled Macroscopically manipulable nanoscale devices made from nanotube assemblies; U.S. Pat. No. 7,940,043, entitled NMR method of detecting precipitants in a hydrocarbon stream; U.S. Pat. No. 7,939,136, entitled Method for forming composites of sub-arrays of fullerene nanotubes; U.S. Pat. No. 7,939,047, entitled Bulk separation of carbon nanotubes by bandgap; U.S. Pat. No. 7,938,991, entitled Polymer/carbon-nanotube interpenetrating networks and process for making same; U.S. Pat. No. 7,938,969, entitled Magnetic purification of a sample; U.S. Pat. No. 7,893,513, entitled Nanoparticle/nanotube-based nanoelectronic devices and chemically-directed assembly thereof; U.S. Pat. No. 7,887,774, entitled Methods for selective functionalization and separation of carbon nanotubes; U.S. Pat. No. 7,879,940, entitled Polymerization initated at sidewalls of carbon nanotubes; U.S. Pat. No. 7,858,186, entitled Fluorinated nanodiamond as a precursor for solid substrate surface coating using wet chemistry; U.S. Pat. No. 7,838,077, entitled Functionalized, hydrogen-passivated silicon surfaces; U.S. Pat. No. 7,829,119, entitled Method to fabricate microcapsules from polymers and charged nanoparticles; U.S. Pat. No. 7,825,064, entitled Supported catalysts using nanoparticles as the support material; U.S. Pat. No. 7,821,079, entitled Preparation of thin film transistors (TFTs) or radio frequency identification (RFID) tags or other printable electronics using ink-jet printer and carbon nanotube inks; U.S. Pat. No. 7,820,130, entitled Functionalization of nanodiamond powder through fluorination and subsequent derivatization reactions; U.S. Pat. No. 7,790,066, entitled Nanorice particles: hybrid plasmonic nano structures; U.S. Pat. No. 7,758,841, entitled Reductive functionalization of carbon nanotubes; U.S. Pat. No. 7,744,844, entitled Functionalized carbon nanotube-polymer composites and interactions with radiation; U.S. Pat. No. 7,740,826, entitled Method for functionalizing carbon nanotubes utilizing peroxides; U.S. Pat. No. 7,730,547, entitled Smart materials: strain sensing and stress determination by means of nanotube sensing systems, composites, and devices; U.S. Pat. No. 7,727,504, entitled Fibers comprised of epitaxially grown single-wall carbon nanotubes, and a method for added catalyst and continuous growth at the tip; U.S. Pat. No. 7,718,550, entitled Method for low temperature growth of inorganic materials from solution using catalyzed growth and re-growth; U.S. Pat. No. 7,692,218, entitled Method for creating a functional interface between a nanoparticle, nanotube or nanowire, and a biological molecule or system; U.S. Pat. No. 7,682,527, entitled Fabrication of light emitting film coated fullerenes and their application for in-vivo light emission; U.S. Pat. No. 7,682,523, entitled Fluorescent security ink using carbon nanotubes; U.S. Pat. No. 7,670,583, entitled Multi-step purification of single-wall carbon nanotubes; U.S. Pat. No. 7,655,302, entitled Continuous fiber of fullerene nanotubes; U.S. Pat. No. 7,632,569, entitled Array of fullerene nanotubes; U.S. Pat. No. 7,632,481, entitled Sidewall functionalization of nanotubes with hydroxyl terminated moieties; U.S. Pat. No. 7,601,421, entitled Fabrication of carbon nanotube reinforced epoxy polymer composites using functionalized carbon nanotubes; U.S. Pat. No. 7,585,420, entitled Carbon nanotube substrates and catalyzed hot stamp for polishing and patterning the substrates; U.S. Pat. No. 7,578,941, entitled Length-based liquid-liquid extraction of carbon nanotubes using a phase transfer catalyst; U.S. Pat. No. 7,572,426, entitled Selective functionalization of carbon nanotubes; U.S. Pat. No. 7,527,831, entitled Method of making a molecule-surface interface; U.S. Pat. No. 7,511,811, entitled Pulsed-multiline excitation for color-blind fluorescence detection; U.S. Pat. No. 7,510,695, entitled Method for forming a patterned array of fullerene nanotubes; U.S. Pat. No. 7,494,639, entitled Purification of carbon nanotubes based on the chemistry of fenton's reagent; U.S. Pat. No. 7,481,989, entitled Method for cutting fullerene nanotubes; U.S. Pat. No. 7,470,417, entitled Ozonation of carbon nanotubes in fluorocarbons; U.S. Pat. No. 7,452,519, entitled Sidewall functionalization of single-wall carbon nanotubes through C—N bond forming substitutions of fluoronanotubes; U.S. Pat. No. 7,419,651, entitled Method for producing self-assembled objects comprising fullerene nanotubes and compositions thereof; U.S. Pat. No. 7,419,624, entitled Methods for producing composites of fullerene nanotubes and compositions thereof; U.S. Pat. No. 7,407,640, entitled Functionalized carbon nanotube-polymer composites and interactions with radiation; U.S. Pat. No. 7,390,767, entitled Method for producing a catalyst support and compositions thereof; U.S. Pat. No. 7,390,477, entitled Fullerene nanotube compositions; U.S. Pat. No. 7,361,369, entitled Implant with structure allowing injection of polymer for attaching implant to tissue; U.S. Pat. No. 7,357,906, entitled Method for fractionating single-wall carbon nanotubes; U.S. Pat. No. 7,354,563, entitled Method for purification of as-produced fullerene nanotubes; U.S. Pat. No. 7,324,215, entitled Non-destructive optical imaging system for enhanced lateral resolution; U.S. Pat. No. 7,323,136, entitled Containerless mixing of metals and polymers with fullerenes and nanofibers to produce reinforced advanced materials; U.S. Pat. No. 7,306,828, entitled Fabrication of reinforced composite material comprising carbon nanotubes, fullerenes, and vapor-grown carbon fibers for thermal barrier materials, structural ceramics, and multifunctional nanocomposite ceramics; U.S. Pat. No. 7,264,876, entitled Polymer-wrapped single wall carbon nanotubes; U.S. Pat. No. 7,262,266, entitled Copolymerization of polybenzazoles and other aromatic polymers with carbon nanotubes; U.S. Pat. No. 7,253,014, entitled Fabrication of light emitting film coated fullerenes and their application for in-vivo light emission; U.S. Pat. No. 7,205,069, entitled Membrane comprising an array of single-wall carbon nanotubes; U.S. Pat. No. 7,204,970, entitled Single-wall carbon nanotubes from high pressure CO; U.S. Pat. No. 7,176,146, entitled Method of making a molecule-surface interface; U.S. Pat. No. 7,125,533, entitled Method for functionalizing carbon nanotubes utilizing peroxides; U.S. Pat. No. 7,115,864, entitled Method for purification of as-produced single-wall carbon nanotubes; U.S. Pat. No. 7,108,841, entitled Method for forming a patterned array of single-wall carbon nanotubes; U.S. Pat. No. 7,105,596, entitled Methods for producing composites of single-wall carbon nanotubes and compositions thereof; U.S. Pat. No. 7,097,820, entitled Continuous fiber of single-wall carbon nanotubes; U.S. Pat. No. 7,087,207, entitled Method for forming an array of single-wall carbon nanotubes in an electric field and compositions thereof; U.S. Pat. No. 7,071,406, entitled Array of single-wall carbon nanotubes; U.S. Pat. No. 7,067,098, entitled Method for forming an array of single-wall carbon nanotubes and compositions thereof; U.S. Pat. No. 7,052,666, entitled Method for cutting single-wall carbon nanotubes; U.S. Pat. No. 7,048,999, entitled Method for producing self-assembled objects comprising single-wall carbon nanotubes and compositions thereof; U.S. Pat. No. 7,048,903, entitled Macroscopically manipulable nanoscale devices made from nanotube assemblies; U.S. Pat. No. 7,041,620, entitled Method for producing a catalyst support and compositions thereof; U.S. Pat. No. 7,029,646, entitled Method for cutting single-wall carbon nanotubes through fluorination; U.S. Pat. No. 7,008,604, entitled Method for cutting nanotubes; U.S. Pat. No. 7,008,563, entitled Polymer-wrapped single wall carbon nanotubes; U.S. Pat. No. 6,995,841, entitled Pulsed-multi-line excitation for color-blind fluorescence detection; U.S. Pat. No. 6,986,876, entitled Method for forming composites of sub-arrays of single-wall carbon nanotubes; U.S. Pat. No. 6,979,709, entitled Continuous fiber of single-wall carbon nanotubes; U.S. Pat. No. 6,949,237, entitled Method for growing single-wall carbon nanotubes utlizing seed molecules; U.S. Pat. No. 6,939,525, entitled Method of forming composite arrays of single-wall carbon nanotubes and compositions thereof; U.S. Pat. No. 6,936,306, entitled Chemical control over ceramic porosity using carboxylate-alumoxanes; U.S. Pat. No. 6,936,233, entitled Method for purification of as-produced single-wall carbon nanotubes; U.S. Pat. No. 6,875,475, entitled Methods for producing submicron metal line and island arrays; U.S. Pat. No. 6,824,755, entitled Method for producing a catalyst support and compositions thereof; U.S. Pat. No. 6,778,316, entitled Nanoparticle-based all-optical sensors; U.S. Pat. No. 6,761,870, entitled Gas-phase nucleation and growth of single-wall carbon nanotubes from high pressure CO; U.S. Pat. No. 6,756,026, entitled Method for growing continuous carbon fiber and compositions thereof; U.S. Pat. No. 6,756,025, entitled Method for growing single-wall carbon nanotubes utilizing seed molecules; U.S. Pat. No. 6,749,827, entitled Method for growing continuous fiber; U.S. Pat. No. 6,683,783, entitled Carbon fibers formed from single-wall carbon nanotubes; U.S. Pat. No. 6,428,762, entitled Powder synthesis and characterization of amorphous carbon nitride, a-C3N4; U.S. Pat. No. 6,369,183, entitled Methods and materials for fabrication of alumoxane polymers; U.S. Pat. No. 6,322,890, entitled Supra-molecular alkylalumoxanes; U.S. Pat. No. 6,124,373, entitled Bone replacement compound comprising poly(polypropylene fumarate); U.S. Pat. No. 6,018,390, entitled Integrated optics waveguide accelerometer with a proof mass adapted to exert force against the optical waveguide during acceleration; or U.S. Patent Application Publication Nos.: 20160163652, entitled COATED FULLERENES, COMPOSITES AND DIELECTRICS MADE THEREFROM; 20160153098, entitled SELF-IMPROVING ELECTROCATALYSTS FOR GAS EVOLUTION REACTIONS; 20160137875, entitled CONDUCTIVE POLYMER COATING COMPOSITION; 20160131637, entitled SUSPENDED NANO-ELECTRODES FOR ON-CHIP ELECTROPHYSIOLOGY; 20160068690, entitled CARBON NANOTUBE COATING COMPOSITION; 20160002673, entitled SOLAR STEAM PROCESSING OF BIOFUEL FEEDSTOCK AND SOLAR DISTILLATION OF BIOFUELS; 20150368539, entitled CARBONACEOUS NANOPARTICLES AS CONDUCTIVITY ENHANCEMENT ADDITIVES TO WATER-IN-OIL EMULSIONS, OIL-IN-WATER EMULSIONS AND OIL-BASED WELLBORE FLUIDS; 20150360956, entitled PRODUCTION OF GRAPHENE NANOPLATELETS BY OXIDATIVE ANHYDROUS ACIDIC MEDIA; 20150307357, entitled PRODUCTION OF GRAPHENE NANORIBBONS BY OXIDATIVE ANHYDROUS ACIDIC MEDIA; 20150298164, entitled CARBON NANOTUBE FILMS PROCESSED FROM STRONG ACID SOLUTIONS AND METHODS FOR PRODUCTION THEREOF; 20150280248, entitled GRAPHENE QUANTUM DOT-CARBON MATERIAL COMPOSITES AND THEIR USE AS ELECTROCATALYSTS; 20150216975, entitled NANOVECTOR BASED DRUG DELIVERY SYSTEM FOR OVERCOMING DRUG RESISTANCE; 20150162381, entitled ADDRESSABLE SIOX MEMORY ARRAY WITH INCORPORATED DIODES; 20150108391, entitled SYNTHESIS OF MAGNETIC CARBON NANORIBBONS AND MAGNETIC FUNCTIONALIZED CARBON NANORIBBONS; 20150023858, entitled REBAR HYBRID MATERIALS AND METHODS OF MAKING THE SAME; 20140367091, entitled WELLBORE FLUIDS INCORPORATING MAGNETIC CARBON NANORIBBONS AND MAGNETIC FUNCTIONALIZED CARBON NANORIBBONS AND METHODS OF USING THE SAME; 20140363669, entitled CARBON NANOTUBES FIBER HAVING LOW RESISTIVITY, HIGH MODULUS AND/OR HIGH THERMAL CONDUCTIVITY AND A METHOD OF PREPARING SUCH FIBERS BY SPINNING USING A FIBER SPIN-DOPE; 20140357534, entitled METHODS, APPARATUS, AND SENSORS FOR TRACING FRAC FLUIDS IN MINERAL FORMATIONS, PRODUCTION WATERS, AND THE ENVIRONMENT USING MAGNETIC PARTICLES; 20140313636, entitled GRAPHENE-CARBON NANOTUBE HYBRID MATERIALS AND USE AS ELECTRODES; 20140255291, entitled LIQUID CRYSTALS FROM SINGLE-WALLED CARBON NANOTUBE POLYELECTROLYTES AND THEIR USE FOR MAKING VARIOUS MATERIALS; 20140193711, entitled COMBINED ELECTROCHEMICAL AND CHEMICAL ETCHING PROCESSES FOR GENERATION OF POROUS SILICON PARTICULATES; 20140187651, entitled MULTI-HIERARCHICAL SELF-ASSEMBLY OF A COLLAGEN MIMETIC PEPTIDE; 20140178688, entitled BERNAL-STACKED GRAPHENE LAYERS AND METHODS OF MAKING THE SAME; 20140154269, entitled TARGETED NANOVECTORS AND THEIR USE FOR TREATMENT OF BRAIN TUMORS; 20140141224, entitled FABRICATION OF CARBON FOAMS THROUGH SOLUTION PROCESSING IN SUPERACIDS; 20140120453, entitled PATTERNED GRAPHITE OXIDE FILMS AND METHODS TO MAKE AND USE SAME; 20140120167, entitled MULTIFUNCTIONAL CHEMO- AND MECHANICAL THERAPEUTICS; 20140120081, entitled USE OF CARBON NANOMATERIALS WITH ANTIOXIDANT PROPERTIES TO TREAT OXIDATIVE STRESS; 20140103255, entitled ALIPHATIC AMINE BASED NANOCARBONS FOR THE ABSORPTION OF CARBON DIOXIDE; 20140097842, entitled ELECTRON SPIN RESONANCE FOR MEDICAL IMAGING; 20140094391, entitled BIO-NANO-CHIPS FOR ON-SITE DRUG SCREENING; 20140084219, entitled DOPED MULTIWALLED CARBON NANOTUBE FIBERS AND METHODS OF MAKING THE SAME; 20140081067, entitled SORPTION AND SEPARATION OF VARIOUS MATERIALS BY GRAPHENE OXIDES; 20140077138, entitled BORON NITRIDE-BASED FLUID COMPOSITIONS AND METHODS OF MAKING THE SAME; 20140048748, entitled GRAPHENE NANORIBBON COMPOSITES AND METHODS OF MAKING THE SAME; 20140014030, entitled METHODS FOR PRODUCTION OF SINGLE-CRYSTAL GRAPHENES; 20140011034, entitled GRAPHITE OXIDE COATED PARTICULATE MATERIAL AND USES THEREOF; 20130345099, entitled Nano-Encapsulated Triggered-Release Viscosity Breaker; 20130334104, entitled DISTILLING A CHEMICAL MIXTURE USING AN ELECTROMAGNETIC RADIATION-ABSORBING COMPLEX FOR HEATING; 20130319973, entitled LAYER-BY-LAYER REMOVAL OF GRAPHENE; 20130306463, entitled PURIFYING A FLUID USING A HEAT CARRIER COMPRISING AN ELECTROMAGNETIC RADIATION-ABSORBING COMPLEX; 20130299933, entitled PLASMON INDUCED HOT CARRIER DEVICE, METHOD FOR USING THE SAME, AND METHOD FOR MANUFACTURING THE SAME; 20130295580, entitled ORAL CANCER POINT OF CARE DIAGNOSTICS; 20130274136, entitled PROSTATE CANCER POINT OF CARE DIAGNOSTICS; 20130264121, entitled GRAPHENE-BASED MATERIAL FOR SHALE STABILIZATION AND METHOD OF USE; 20130190472, entitled POLYAMIDE COMPOSITES HAVING FLEXIBLE SPACERS; 20130168543, entitled ANALYZING THE TRANSPORT OF PLASMONIC PARTICLES THROUGH MINERAL FORMATIONS; 20130130933, entitled BIOMARKER SIGNATURES FOR WELLNESS TESTING; 20130108826, entitled PRODUCTION OF HIGHLY CONDUCTIVE CARBON NANOTUBE-POLYMER COMPOSITES; 20130095314, entitled IMMOBILIZED CARBON NANOTUBES ON VARIOUS SURFACES; 20130090511, entitled SYNTHESIS OF ULTRASMALL METAL OXIDE NANOPARTICLES; 20130069271, entitled DYNAMIC STRAIN HARDENING IN POLYMER NANOCOMPOSITES; 20130048339, entitled TRANSPARENT ELECTRODES BASED ON GRAPHENE AND GRID HYBRID STRUCTURES; 20130045420, entitled ANODE BATTERY MATERIALS AND METHODS OF MAKING THE SAME; 20130017453, entitled Conformal Coating On Nanostructured Electrode Materials For Three-Dimensional Applications; 20120302816, entitled THERAPEUTIC COMPOSITIONS AND METHODS FOR TARGETED DELIVERY OF ACTIVE AGENTS; 20120267893, entitled ELECTRICITY GENERATION USING ELECTROMAGNETIC RADIATION; 20120238021, entitled METHODS OF SYNTHESIZING THREE-DIMENSIONAL HETEROATOM-DOPED CARBON NANOTUBE MACRO MATERIALS AND COMPOSITIONS THEREOF; 20120231326, entitled STRUCTURED SILICON BATTERY ANODES; 20120213994, entitled X-RAY ABSORBING COMPOSITIONS AND METHODS OF MAKING THE SAME; 20120208008, entitled GRAPHENE-BASED THIN FILMS IN HEAT CIRCUITS AND METHODS OF MAKING THE SAME; 20120189492, entitled FULLERENE COMPOSITIONS AND METHODS FOR PHOTOCHEMICAL PURIFICATION; 20120156102, entitled WASTE REMEDIATION; 20120155841, entitled GENERATING A HEATED FLUID USING AN ELECTROMAGNETIC RADIATION-ABSORBING COMPLEX; 20120153621, entitled COOLING SYSTEMS AND HYBRID A/C SYSTEMS USING AN ELECTROMAGNETIC RADIATION-ABSORBING COMPLEX; 20120119162, entitled Coated Fullerenes, Compositions And Dielectrics Made Therefrom; 20120090816, entitled SYSTEMS AND METHODS FOR HEAT TRANSFER UTILIZING HEAT EXCHANGERS WITH CARBON NANOTUBES; 20120024153, entitled ALIPHATIC AMINE BASED NANOCARBONS FOR THE ABSORPTION OF CARBON DIOXIDE; 20110318248, entitled Methods for Solubilizing and Separating Large Fullerenes; 20110311427, entitled Strongly Bound Carbon Nanotube Arrays Directly Grown On Substrates And Methods For Production Thereof; 20110287462, entitled PROTEIN FRAGMENT COMPLEMENTATION ASSAY FOR THERMOPHILES; 20110274624, entitled CONTRAST AGENTS IN POROUS PARTICLES; 20110220839, entitled CONVERTING NANOPARTICLES IN OIL TO AQUEOUS SUSPENSIONS; 20110213288, entitled Device And Method For Transfecting Cells For Therapeutic Uses; 20110201764, entitled POLYMER/CARBON-NANOTUBE INTERPENETRATING NETWORKS AND PROCESS FOR MAKING SAME; 20110086781, entitled METHOD FOR FORMING COMPOSITES OF SUB-ARRAYS OF FULLERENE NANOTUBES; 20110079770, entitled Preparation of Thin Film Transistors (TFTs) or Radio Frequency Identification (RFID) Tags or Other Printable Electronics Using Ink-Jet Printer and Carbon Nanotube Inks; 20110065946, entitled FLUORINATED NANODIAMOND AS A PRECURSOR FOR SOLID SUBSTRATE SURFACE COATING USING WET CHEMISTRY; 20110032511, entitled SYSTEM AND METHOD TO MEASURE NANO-SCALE STRESS AND STRAIN IN MATERIALS; 20100317820, entitled Polyol Functionalized Water Soluble Carbon Nanostructures; 20100303913, entitled Method for Nanoencapsulation; 20100294976, entitled COMPOSITION FOR ENERGY GENERATOR, STORAGE, AND STRAIN SENSOR AND METHODS OF USE THEREOF; 20100289524, entitled Method for Fabrication of a Semiconductor Element and Structure Thereof; 20100287374, entitled Protecting Hardware Circuit Design by Secret Sharing; 20100284898, entitled BULK CUTTING OF CARBON NANOTUBES USING ELECTRON BEAM IRRADIATION; 20100284156, entitled VERTICALLY-STACKED ELECTRONIC DEVICES HAVING CONDUCTIVE CARBON FILMS; 20100283504, entitled METHOD FOR FABRICATION OF A SEMICONDUCTOR ELEMENT AND STRUCTURE THEREOF; 20100279128, entitled Single-Crystalline Metal Nanorings and Methods for Synthesis Thereof; 20100252824, entitled Hybrid Molecular Electronic Devices Containing Molecule-Functionalized Surfaces for Switching, Memory, and Sensor Applications and Methods for Fabricating Same; 20100222536, entitled Method for Functionalizating Carbon Naontubes Utilizing Peroxides; 20100222501, entitled SCALABLE PROCESS FOR SYNTHESIZING UNIFORMLY-SIZED COMPOSITE NANOPARTICLES; 20100209632, entitled Fluorescent Carbon Nanotube Compositions Deposited on Surfaces; 20100186665, entitled Method for low temperature growth of inorganic materials from solution using catalyzed growth and re-growth; 20100151248, entitled Fabrication of light emitting film coated fullerenes and their application for in-vivo emission; 20100143230, entitled METHOD FOR PREPARATION OF NEW SUPERHARD B-C-N MATERIAL AND MATERIAL MADE THEREFROM; 20100139946, entitled SELF-ASSEMBLED NANOPARTICLES-NANOTUBE STRUCTURES BASED ON ANTENNA CHEMISTRY OF CONDUCTIVE NANORODS; 20100133513, entitled NANOPARTICLE/NANOTUBE-BASED NANOELECTRONIC DEVICES AND CHEMICALLY-DIRECTED ASSEMBLY THEREOF; 20100120942, entitled SYNTHESIS OF METAL AND METAL OXIDE NANOPARTICLE-EMBEDDED SILOXANE COMPOSITES; 20100113696, entitled METHODS FOR PREPARING CARBON NANOTUBE/POLYMER COMPOSITES USING FREE RADICAL PRECURSORS; 20100108884, entitled Micromechanical Devices for Materials Characterization; 20100096265, entitled MACROSCOPICALLY MANIPULABLE NANOSCALE DEVICES MADE FROM NANOTUBE ASSEMBLIES; 20100040549, entitled Composition for Targeted Drug Delivery and Controlled Release; 20100035047, entitled METAL AND METAL OXIDE NANOPARTICLE-EMBEDDED COMPOSITES; 20100028680, entitled Nonconcentric nanoshells and methods of making and using same; 20100028247, entitled METHODS FOR SELECTIVE FUNCTIONALIZATION AND SEPARATION OF CARBON NANOTUBES; 20100021367, entitled FACILE PURIFICATION OF CARBON NANOTUBES WITH LIQUID BROMINE AT ROOM TEMPERATURE; 20100008843, entitled MULTI-STEP PURIFICATION OF SINGLE-WALL CARBON NANOTUBES; 20090294753, entitled CARBON NANOTUBE DIAMETER SELECTION BY PRETREATMENT OF METAL CATALYSTS ON SURFACES; 20090269593, entitled FUNCTIONALIZED, HYDROGEN-PASSIVATED SILICON SURFACES; 20090197315, entitled FULLERENE-BASED AMINO ACIDS; 20090173935, entitled PREPARATION OF THIN FILM TRANSISTORS (TFT's) OR RADIO FREQUENCY IDENTIFICATION (RFID) TAGS OR OTHER PRINTABLE ELECTRONICS USING INK-JET PRINTER AND CARBON NANOTUBE INKS; 20090169463, entitled ARRAY OF FULLERENE NANOTUBES; 20090124747, entitled CONDENSATION POLYMERS HAVING COVALENTLY BOUND CARBON NANOTUBES; 20090099276, entitled FUNCTIONALIZED CARBON NANOTUBE-POLYMER COMPOSITES AND INTERACTIONS WITH RADIATION; 20090027069, entitled FUNCTIONALIZED CARBON NANOTUBE-POLYMER COMPOSITES AND INTERACTIONS WITH RADIATION; 20090004094, entitled METHOD FOR CUTTING FULLERENE NANOTUBES; 20080311025, entitled METHOD FOR FORMING A PATTERNED ARRAY OF FULLERENE NANOTUBES; 20080260616, entitled Bulk Separation of Carbon Nanotubes by Bandgap; 20080224100, entitled METHODS FOR PRODUCING COMPOSITES OF FULLERENE NANOTUBES AND COMPOSITIONS THEREOF; 20080213162, entitled Amplification of Carbon Nanotubes Via Seeded-Growth Methods; 20080176212, entitled All optical nanoscale sensor; 20080171204, entitled Fabrication of light emitting film coated fullerenes and their application for in-vivo light emission; 20080169061, entitled INTERACTION OF MICROWAVES WITH CARBON NANOTUBES TO FACILITATE MODIFICATION; 20080107586, entitled METHOD FOR PRODUCING A CATALYST SUPPORT AND COMPOSITIONS THEREOF; 20080105648, entitled Carbon nanotube substrates and catalyzed hot stamp for polishing and patterning the substrates; 20080089830, entitled FULLERENE NANOTUBE COMPOSITIONS; 20080063588, entitled METHOD FOR PURIFICATION OF AS-PRODUCED FULLERENE NANOTUBES; 20080063585, entitled FULLERENE NANOTUBE COMPOSITIONS; 20080048364, entitled Polymer/Carbon-Nanotube Interpenetrating Networks and Process for Making Same; 20080014654, entitled Efficient fluorimetric analyzer for single-walled carbon nanotubes; 20070298669, entitled Sidewall Functionalization Of Carbon Nanotubes With Organosilanes For Polymer Composites; 20070297216, entitled SELF-ASSEMBLY OF MOLECULAR DEVICES; 20070280876, entitled Functionalization of Carbon Nanotubes in Acidic Media; 20070259994, entitled Elastomers Reinforced with Carbon Nanotubes; 20070249180, entitled METHOD OF MAKING A MOLECULE-SURFACE INTERFACE; 20070228317, entitled FABRICATION OF REINFORCED COMPOSITE MATERIAL COMPRISING CARBON NANOTUBES, FULLERENES, AND VAPOR-GROWN CARBON FIBERS FOR THERMAL BARRIER MATERIALS, STRUCTURAL CERAMICS, AND MULTIFUNCTIONAL NANOCOMPOSITE CERAMICS; 20070204790, entitled Solvents and new method for the synthesis of cdse semiconductor nanocrystals; 20070118937, entitled Copolymerization and copolymers of aromatic polymers with carbon nanotubes and products made therefrom; 20070110658, entitled Water-soluble single-wall carbon nanotubes as a platform technology for biomedical applications; 20070099792, entitled Carbon nanotube reinforced thermoplastic polymer composites achieved through benzoyl peroxide initiated interfacial bonding to polymer matrices; 20070098620, entitled Method for functionalizing carbon nanotubes utilizing peroxides; 20070071667, entitled Thermal treatment of functionalized carbon nanotubes in solution to effect their functionalization; 20070062411, entitled Fluorescent security ink using carbon nanotubes; 20070048209, entitled Continuous fiber of fullerene nanotubes; 20070043158, entitled Method for producing self-assembled objects comprising fullerene nanotubes and compositions thereof; 20070009421, entitled Fibers comprised of epitaxially grown single-wall carbon nanotubes, and a method for added catalyst and continuous growth at the tip; 20070009417, entitled Supported catalysts using nanoparticles as the support material; 20060269467, entitled Fluorinated nanodiamond as a precursor for solid substrate surface coating using wet chemistry; 20060253942, entitled Smart materials: strain sensing and stress determination by means of nanotube sensing systems, composites, and devices; 20060202168, entitled Functionalized carbon nanotube-polymer composites and interactions with radiation; 20060201880, entitled Length-based liquid-liquid extraction of carbon nanotubes using a phase transfer catalyst; 20060171874, entitled Sidewall functionalization of single-wall carbon nanotubes through C-N bond forming substitutions of fluoronanotubes; 20060166003, entitled Fabrication of carbon nanotube reinforced epoxy polymer composites using functionalized carbon nanotubes; 20060159921, entitled Method to fabricate inhomogeneous particles; 20060159612, entitled Ozonation of carbon nanotubes in fluorocarbons; 20060148272, entitled Fabrication of light emitting film coated fullerenes and their application for in-vivo light emission; 20060139634 Pulsed-multiline excitation for color-blind fluorescence detection; 20060135001, entitled Method for low temperature growth of inorganic materials from solution using catalyzed growth and regrowth; 20060051290, entitled Short carbon nanotubes as adsorption and retention agents; 20050260120, entitled Method for forming an array of single-wall carbon nanotubes in an electric field and compositions thereof; 20050249656, entitled METHOD FOR FORMING A PATTERNED ARRAY OF SINGLE-WALL CARBON NANOTUBES; 20050244326, entitled Method for fractionating single-wall carbon nanotubes; 20050171281, entitled Copolymerization of polybenzazoles and other aromatic polymers with carbon nanotubes; 20050158390, entitled Method to fabricate microcapsules from polymers and charged nanoparticles; 20050129726, entitled Pre-fabricated tissue-engineered plug; 20050089684, entitled Coated fullerenes, composites and dielectrics made therefrom; 20050018274, entitled Nanoparticle-based all-optical sensors; 20040265209, entitled Method for end-derivatizing single-wall carbon nanotubes and for introducing an endohedral group to single-wall carbon nanotubes; 20040223900, entitled Method for functionalizing carbon nanotubes utilizing peroxides; 20040222081, entitled Use of microwaves to crosslink carbon nanotubes; 20040222080, entitled Use of microwaves to crosslink carbon nanotubes to facilitate modification; 20040023479, entitled Method of making a molecule-surface interface; 20040009298, entitled Methods for producing submicron metal line and island arrays; 20030215638, entitled Reduced symmetry nanoparticles;

20030174384, entitled Nanoparticle-based all-optical sensors; 20030106998, entitled Method for producing boron nitride coatings and fibers and compositions thereof; 20030066960, entitled Apparatus for growing continuous single-wall carbon nanotube fiber; 20030010910, entitled Continuous fiber of single-wall carbon nanotubes; 20020159943, entitled Method for forming an array of single-wall carbon nanotubes and compositions thereof; 20020150524, entitled Methods for producing composites of single-wall carbon nanotubes and compositions thereof; 20020136683, entitled Method for forming composites of sub-arrays of single-wall carbon nanotubes; 20020136681, entitled Method for producing a catalyst support and compositions thereof; 20020127169, entitled Method for purification of as-produced single-wall carbon nanotubes; 20020127162, entitled Continuous fiber of single-wall carbon nanotubes; 20020109087, entitled Method for producing a catalyst support and compositions thereof; 20020109086, entitled Method for growing continuous carbon fiber and compositions thereof; 20020102201, entitled Method for forming an array of single-wall carbon nanotubes in an electric field and compositions thereof; 20020102196, entitled Compositions and articles of manufacture; 20020098135, entitled Array of single-wall carbon nanotubes; 20020096634, entitled Method for cutting single-wall carbon nanotubes; 20020094311, entitled Method for cutting nanotubes; 20020092984, entitled Method for purification of as-produced single-wall carbon nanotubes; 20020092983, entitled Method for growing single-wall carbon nanotubes utilizing seed molecules; 20020090331, entitled Method for growing continuous fiber; 20020090330, entitled Method for growing single-wall carbon nanotubes utlizing seed molecules; 20020088938, entitled Method for forming an array of single-wall carbon nanotubes and compositions thereof; 20020085968, entitled Method for producing self-assembled objects comprising single-wall carbon nanotubes and compositions thereof; and 20020084410, entitled Macroscopically manipulable nanoscale devices made from nanotube assemblies, the disclosures of which are incorporated herein in their entireties by reference thereto.

For example, electro-thermal nanotubes may be held in suspension within a urethane base. The electro-thermal nanotubes may be microscopic fibers of carbon that may conduct electricity, convert electricity into thermal energy, and are very durable. When energized, the nanotubes may act as resistive heating elements that heat up as electrical energy flows through, and may increase in temperature as the electrical energy increases, thereby, the nanotube coating may function as a radiant heat source. The electro-thermal nanotubes may work with either alternating current (AC) or direct current (DC) electrical sources and temperature control may be achieved using off the shelf technology. A nanotube/urethane composite may be used as a spray on thermal coating that may convert a surface, on to which the composite is sprayed, into a radiant heat source.

While composite heating elements including carbon nanotubes are described herein in conjunction with heated garments, the composite heating elements may be incorporated into numerous applications (e.g., heating asphalt, heating concrete, heating airplane wings and fuselages, water heaters, air heating, heating batteries, heated food containers, heated drink containers, etc.). In fact, the composite heating elements of the present disclosure may generally be incorporated in any convection, conduction or radiant heating application.

Figure 2:
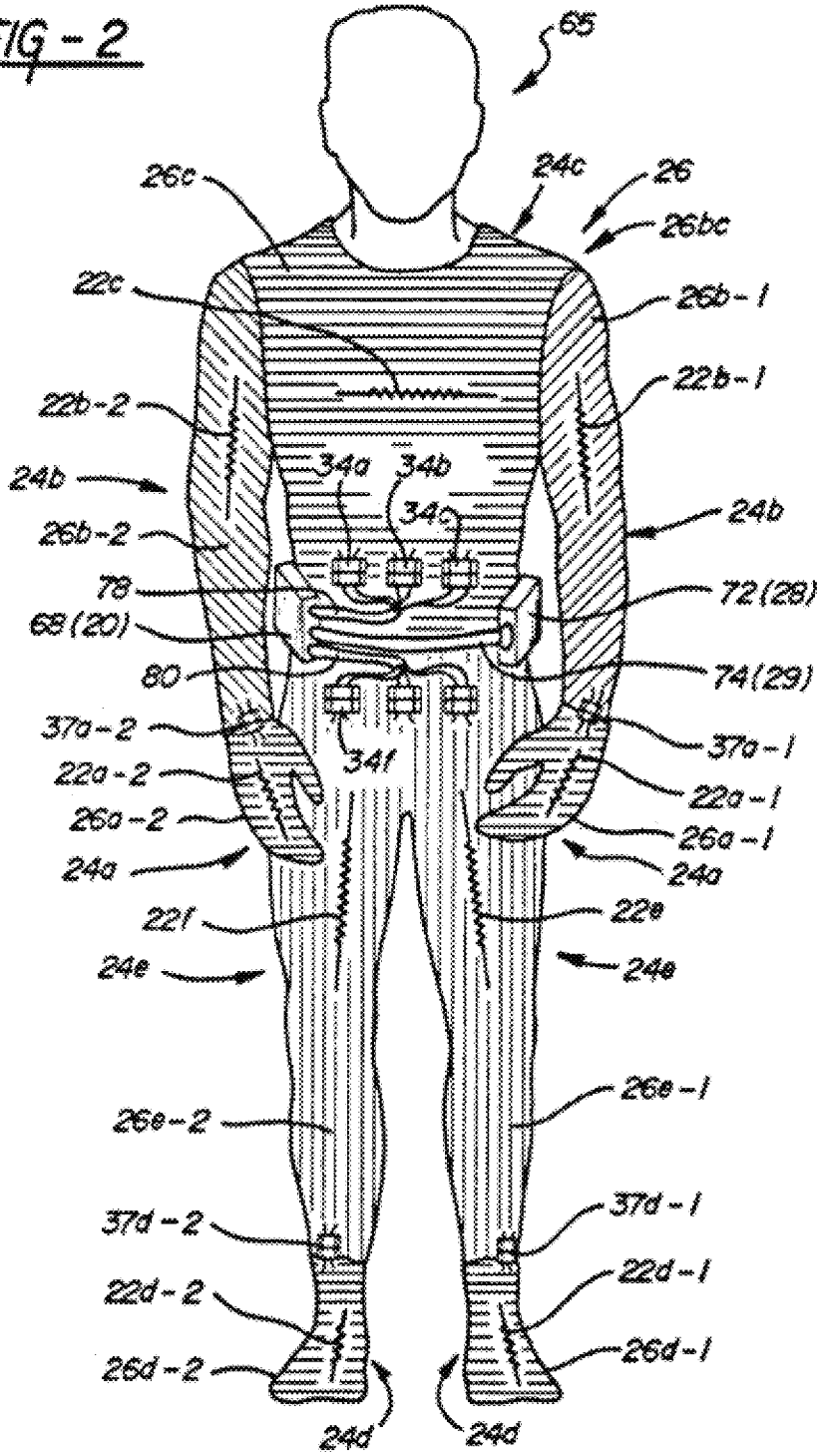
FIG. 2 depicts example heated garments.

With reference to FIG. 1, an electronic control system 20 may include a proportional, open-loop control system which may, for example, supply pulse width modulated (PWM) current signals to heating elements 22*a*-22*f*, respectively located within independent heating zones 24*a*-24*e* of electrically heated garments 26. The garments 26, and independent zones, are indicated by dashed line blocks in FIG. 1. The independent heating zones 24*a*-24*e* of the garments 26 will be discussed in more detail in connection with FIG. 2. The system 20 may be, for example, constructed on single printed circuit ("PC") board housed with a small wearable injection-molded plastic housing, as shown in FIG. 2.

The system 20 may be powered by any suitable electrical power source such as internal or external batteries, a solar photovoltaic panel and/or a power cord connected to any convenient source of power such as a portable generator or the electrical system of a boat, snowmobile, cycle or jeep. Due to weight considerations, an external source of power may be preferred over batteries when available, and is represented by external power supply 28 in FIG. 1. The power source may provide, to the control system 20, a substantially constant voltage, direct current ("DC") signal in the range of about 10 to 24 volts, and more preferably 12 to 14 volts. However, if desired, an alternating current ("AC") source may be used by providing a conventional AC-to-DC converter as part of the system 20.

DC electrical power may be supplied through conductors 29 to electrical connectors 30 and then through two suitably sized fuses 31, which in turn supply power through electrical connectors 32 and conductors 33 to fused electrical connectors 34 leading to the heating elements 22*a*-22*f*. The electrical power, after passing through the elements 22, may travel through return paths within connectors 34 to wires 35 that lead back to electrical connectors 32 leading to the control system 20. Additional electrical connectors 37*a* and 37*d* may also be provided for the heating elements 22*a* and 22*d* so that hand and sock sections of the garments 26 may be separately disconnected. The connectors 30, 32 and 32' may be conventional edge connectors which may fasten to a PC board of the system 20.

The control system 20 may include: a group 36 of solid-state power switching ("SW") devices 36*a*-36*f*, a group 38 of user-adjustable power level selection ("PLS") circuits 38*a*-38*e*, an internal power regulator circuit 39, an optional user-adjustable master power level selection circuit 40, a periodic waveform generator 42, and/or current-limiting protection circuitry 44.

The power regulator circuit 39 may be of conventional design and may convert a small portion of the unregulated electrical power from connectors 30 into +5 volts DC for use as needed by the other circuits within system 20. The group 36 of switching ("SW") means 36*a*-36*f* may be for rapidly and independently turning on and off the heating element or elements of each of the heating zones 24*a*-24*e*. Each of the switching means 36 preferably includes a metal-oxide semiconductor field effect ("MOSFET") power transistor. These switching transistors 36*a*-36*f* may be controlled by the group 38 of first power level selection means 38*a*-38*e*, which may be individual circuits that provide pulse width modulated (i.e., rapid on and off) control signals on lines 47*a*-47*e* to cause the desired finely controlled switching action of the switching transistors 36*a*-36*f* to produce the desired average level of heating within each zone. It should be noted that because of the larger amount of current which may be required to heat the leg portions 24*e*, the control system 20 may incorporate separate switching transistors 36*e* and 36*f*, as shown in FIG. 1, for the left and right leg heating elements 22*e* and 22*f* respectively. It should be appreciated, however, that the control system 20 may be modified by those skilled in the art to operate with only a single switching transistor 36, and that two switching transistors 36*e* and 36*f* have been incorporated to enhance the operability of the system.

Further control of the switching transistors 36 may be provided through a second or master, power level selection circuit 40. The master power level selection circuit 40 may provide a control signal on line 40*a* for the simultaneous and uniform control or adjustment of the duty cycle of the PWM signals controlling the on and off switching action of all the switching transistors 36. It should be appreciated, however, that the master power level selection circuit 40 is not necessary for proper operation of the system 20, but has been included to provide a global or over-all adjustment for the individual switching transistors 36*a*-36*d*, to thereby provide a wearer of the garments 26 with a way of easily and simultaneously varying the heating levels of all the individual heating elements 22*a*-22*f*, either up or down, as desired.

In the system 20, the waveform generator 42 may provide on line 42*a* a repetitive sweep signal, such as a triangular waveform, that is used as the time base in producing the PWM control signals that regulate the switching action of the power transistors 36. The functions and interactions of the individual zone power level selection circuits 38, the master power level selection circuit 40, and how the pulse width modulation may be produced by using a triangle waveform from generator 42.

The current limiting circuit 44 of system 20 may be an overload prevention circuit that monitors the total current flowing through the heating elements 22*a*-22*f*. This monitoring may be accomplished by shunt resistors 45*a*-45*f* which provide individual voltage signals on conductors 46*a*-46*f* to current-limiting circuit 44. When the total current exceeds a predetermined threshold or amount, circuit 44 may supply an overriding control signal via line 44*a* to the master power level selection circuit 40 that may automatically reduce the duty cycle of the PWM signals driving the switching transistors 36, which may limit the current flowing through each of the heating elements 22 in a simultaneous and uniform manner.

Due to the large current requirement for heating the pants zone 34*e*, two separate power switches 36*e* and 36*f*, connectors 32*e* and 32*f* wiring sets 35*e* and 35*f* and heating elements 22*e* and 22*f* are used. Note that the output signal from PLS circuit 44*e* is fed as the PWM input signal on line 47*e* to both power switches 36*e* and 36*f*. In this manner, one PLS circuit 38 identically controls two separate power switches and heating elements.

Turning to FIG. 2, garments 26 may be worn by a human 65. The garments 26 may be worn as an under-garments to maximize heat transfer to the body and to allow insulating layers of clothing to be placed over it to help retain heat which the heating elements 22 generate. The garments 26 is preferably tight-fitting, and highly stretchable to minimize air pockets and other spaces between the garments and the skin that tend to trap air, reduce heat transfer.

FIG. 2 shows different independent heating zones 24*a*-24*e* of the garments 26. Each heating zone may be defined by a spray on, or printed, carbon nanotube based heating element, and may define a logo, a picture, alpha-numeric text, etc. The heating elements 22*a*-1-22*d*-2 are also shown in FIG. 2 as simple resistors to avoid cluttering the Figure. The man 65 is shown wearing, at the right side of his waist, a slim lightweight rectangular enclosure 68 which houses the electronics of the control system 20, and, at the another slim lightweight enclosure 72 which may house any conventional high-energy battery pack. A battery pack may, if desired, serve as the external power supply 28 shown in FIG. 1. A suitable length power cord 74 may be used to connect the pack 72 to system 20 or to another nearby electrical power source.

Electrical wiring harnesses 78 and 80 are used to connect the control system 20 to connectors 34*a* through 34*c* and connectors 34*d* through 34*f* as shown. Harnesses 78 and 80 include conventional insulative protective sheathings 82 and 84, which are represented by dashed lines in FIG. 1. As shown in FIG. 1, wiring harness 78 includes conductors 33*a*-33*c* and 35*a*-35*c*, while wiring harness 80 includes conductors 33*d*-33*f* and 35*d*-35*f*.

The overall garments 26 shown in FIG. 2 may consists of four separately wearable garment, namely: a hand section 26*a* consisting of hand coverings 26*a*-1 and 26*a*-2 (e.g., gloves) to heat the left hand and right hand respectively; the long-sleeve shirt section 26*bc*, or coat, covering arms and torso including shoulders; socks 26*d* consisting of socks 26*d*-1 and 26*d*-2 covering a left foot and right foot respectively; and pants 26*e*-1 and 26*e*-2 covering both legs and a hip area. The hand coverings 26 may be mittens, but preferably are gloves for greater finger dexterity.

In the garments 26 as shown in FIG. 2, heating zone 24*a* may be made up of the two hand coverings 26*a*. Zone 24*b* may include the left and right arm sections 26*b*-1 and 26*b*-2 of the garments 26, while a third zone 24*c* may cover the torso including the shoulders. The socks zone 24*d* may cover both feet including the ankles. The legs zone 24*e*-1 and 24*e*-2 may cover both legs and the hip area. Although five independent zones have been illustrated in FIG. 2, it should be appreciated that any convenient number of discrete independent heating zones may be employed, as long as an appropriate number of power switching devices and independent power level selection circuits are also included in the system 20. For example, an additional zone could be provided so as to heat each hand separately, and/or another zone could be provided to heat the head, assuming of course that another garments section, taking the form of a hood, face mask or the like, is provided.

The garments 26 may define a one-piece suit if desired, or may be constructed as at least a two piece suit comprising a vest or shirt section and a pants section. The term "vest" is used here in its usual sense as an article of clothing that covers most of the torso, but not the arms. The shirt section may be either long-sleeve or short-sleeve or may have an in-between sleeve length. The pants section may similarly have any desired length of pant leg. Such two (or more) piece constructions allow the garments 26 to be easily and quickly put on and removed, and also allow each section to be used or replaced separately. The hand zone 24*a* and socks zone 24*d* are optional, and their respective garments sections 26*a* and 26*d* need not be worn unless desired. To facilitate such optional use, the additional electrical connectors 37*a*-1, 37*a*-2, 37*d*-1 and 37*d*-2 are respectively provided so that the hand coverings 26*a*-1, 26*a*-2 and socks 26*d*-1 and 26*d*-2 may be individually removed whenever desired.

The two piece suit configuration is facilitated by the two sets of connectors 34*a* through 34*c* and 34*d* through 34*f* which are preferably located generally where shown in FIG. 2. The connectors 34*a* through 34*f* each also preferably contain a built-in fuse which may be sized as desired (for example, at 7 to 8 amps) to provide individual short circuit protection for respective electrical heating elements 22*a* through 22*f* in the garments 26. Suitable fused and unfused electrical connector assemblies of the type just mentioned may be attached by sewing one-half of each such connector assembly to respective sections of the garments as shown in FIG. 2. Note that the fuses 31 within control system 20 may also provide protection against short circuits.

The use of these types of connectors 34 and 37, as shown in FIG. 2 and mentioned earlier herein, with each zone 24*a*-24*e* of the garments 26 allows the garments 26 to be readily be configured as desired by the wearer to adapt to specific weather conditions and activity requirements of the wearer. It should also be appreciated that connectors may be used elsewhere, for example, at the shoulder, to make the arm section 26*b* and arm zone 24*b* individually detachable from the torso section 26*c*.

The fabric of the garments 26 may be of any suitable material, but preferably is a polyester blend which is lightweight and not bulky, thereby allowing the garments 26 to be worn comfortably during a wide variety of cold weather outdoor activities. Such a lightweight material should have a weight in the range of about 2 to 20 ounces per square yard, with the preferable range of weight being from about 6 to 8 ounces per square yard.

The fabric of the garments 26 preferably also incorporates material which is stretchable to facilitate flexibility of the various portions of the garments 26 during physical activities of the wearer, and to further enhance the comfort of the garments 26. The break elongation (i.e., a percentage of elongation of the material from a non-elongated or resting state before breakage or tearing occurs) of the fabric should be in the range of preferably about 100% to 1000%. The tensile recovery (i.e., that percentage of recovery of the material from an elongated condition to a non-elongated or resting condition) of such a material should also be in the range of preferably about 50% to 100% from about a 50% elongation. A material incorporating "spandex" fibers would be particularly desirable in this regard. Spandex fibers include a fiber-forming substance in the form of long-chain synthetic polymers comprised of at least about 85% of a segmented polyurethane, and are helpful in imparting elasticity to garments such as girdles, socks, and special hosiery. Another characteristic of a suitable fabric may be its tensile strength. The fabric may have a tensile strength of at least about 0.2 gpd (grams per denier), and preferably about 0.8 gpd or higher.

The fabric of the garments 26 will preferably also incorporate a material having good insulating capabilities. A suitable material for this purpose preferably incorporates fibers made at least partially from polyethylene terephthalate. Material incorporating polyethylene terephthalate fibers will not only provide excellent insulating qualities but will further provide high elastic recovery and good resistance against insect bites.

Still another important consideration in maximizing the comfort provided by the garments 26 is the "wicking" action provided by the fabric. By "wicking", it is meant the ability of the fabric of the garments 26 to absorb moisture and perspiration from the skin of a wearer and dissipate the moisture and/or perspiration through evaporation. The insulating material described above, i.e., material incorporating polyethylene terephthalate fibers, is also particularly effective for this purpose.

The fabric of the garments 26 further preferably has a tight or form-fitting characteristic as mentioned briefly hereinbefore. A form-fitting fabric eliminates an undesirable effect known generally as "pumping". Pumping occurs when a loose-fitting, heated fabric is used in a garments or similar article and results in warm air being "pumped" from within the loose-fitting areas of the fabric, eventually into the ambient environment. This pumping action contributes to inefficiency in the heating operation of a heated garments and results in wasted power of the garments' power source. By employing a tight or form-fitting fabric, however, this undesirable effect is greatly or completely eliminated because air pockets formed between loose-fitting areas of the fabric and a wearer's skin are substantially eliminated. Insulating material incorporating polyethylene terephthalate and spandex fibers are also very effective in this regard, and should preferably be incorporated for this reason.

A very desirable fabric for providing the above qualities is available commercially from E.I. du Pont de Nemours and Co., of Wilmington, Del. ("DuPont"). The fabric generally consists of a blend of about 92% THERMAX and about 8% LYCRA. THERMAX is a trademark of DuPont and consists of 100% DACRON (DACRON also being a DuPont trademark) polyester knit fabric, which is a highly insulating synthetic fabric including polyethylene terephthalate fibers. LYCRA is also a trademark of DuPont for its brand of spandex. This blend of materials is particularly effective in providing a fabric which not only has excellent insulating characteristics and stretchability, but which is also form-fitting, soft, which resists shrinkage, thereby retaining its shape and fit, and which is also machine washable and dryable, as well as mildew and odor-retaining resistant.

The heating elements 22*a*-1-22*f* may be as described in conjunction with FIGS. 3-6. Insulated heating elements may be capable of heating to at least a level which provides a feeling of warmth against the wearer's skin which corresponds to about 100° Fahrenheit, without producing an uncomfortably warm sensation against the skin of the wearer.

Figure 3:
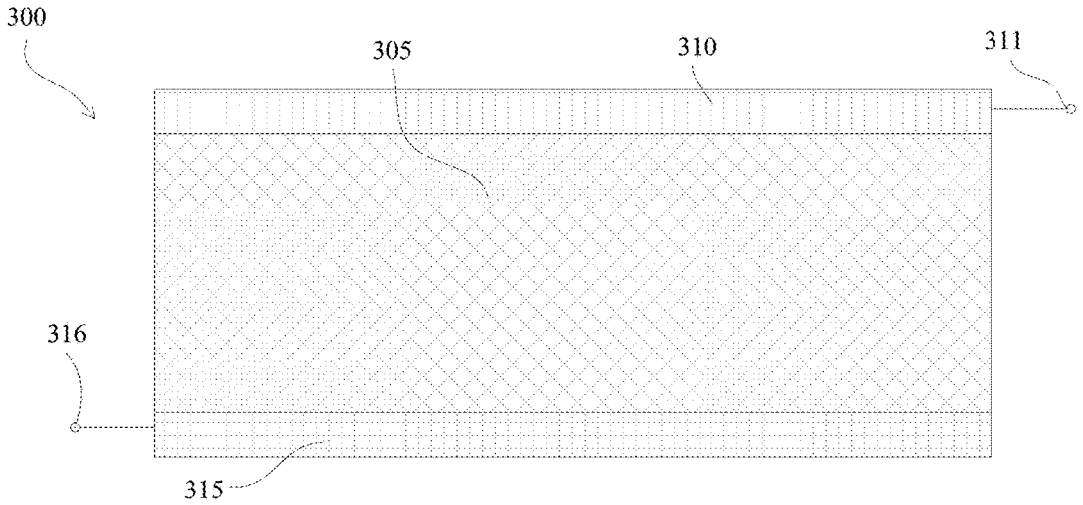
FIG. 3 depicts a plan view of an example nanoparticle composite heater.

With referenced to FIG. 3, a nanoparticle composite heating element 300 may include a nanoparticle composite 305 including a first electrode 310 having an activation connection 311, and a second electrode 315 having a negative connection 312. The nanoparticle composite 305 may include a nanometer-scale tube-like structure (e.g., BCN nanotube, ~BCN nanotube, ~BC2N nanotube, boron nitride nanotube, carbon nanotube, DNA nanotube, gallium nitride nanotube, silicon nanotube, inorganic nanotube, tungsten disulphide nanotube, membrane nanotube having a tubular membrane connection between cells, titania nanotubes, tungsten sulfide nanotubes, etc.). The nanoparticle heating element 300 may be similar to, for example, the nanoparticle composite heating elements 22*a-f* of FIG. 2.

Figure 4:
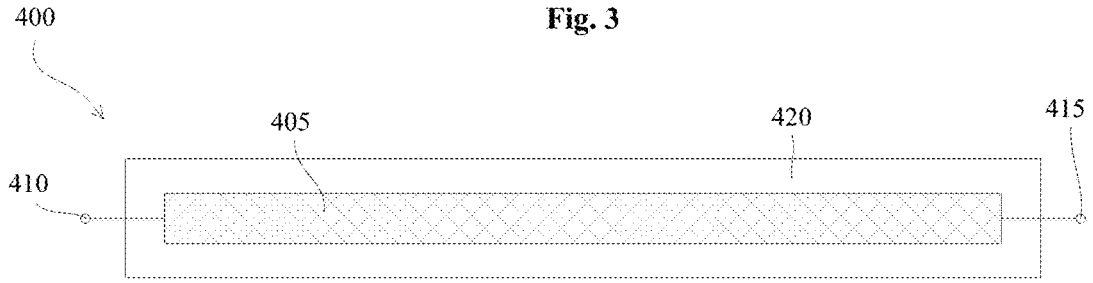
FIG. 4 depicts a profile view of an example nanoparticle composite heater encapsulated within an inert material.

Turning to FIG. 4, a heating element 400 may include a nanoparticle composite heater 405 encapsulated within an inert material 420 (e.g., glass, silicon, porcelain, etc). The nanoparticle heater 405 may be similar to, for example, the nanoparticle composite heating element 22*a-f* of FIG. 2, or the nanoparticle composite heating element 300 of FIG. 3. The heating element 400 may also include an activation terminal 410 and a negative terminal 415.

Figure 5:
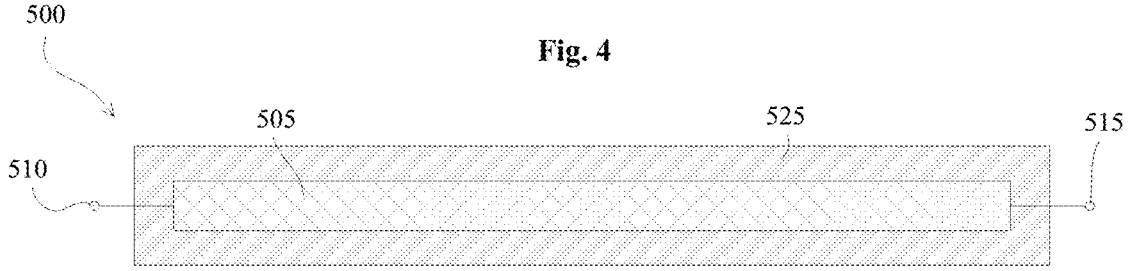
FIG. 5 depicts a profile view of an example nanoparticle composite heater encapsulated within a thermally conductive material.

With reference to FIG. 5, an element 500 may include a nanoparticle composite heater 505 encapsulated within a thermally conductive material 525 (e.g., metal, tin, copper, glass, silicon, porcelain, etc). The nanoparticle heater 505 may be similar to, for example, the nanoparticle composite heating elements 22*a-f* of FIG. 2, the nanoparticle composite heating element 300 of FIG. 3, or the nanoparticle heater 400 of FIG. 4. The heating element 500 may also include an activation terminal 510 and a negative terminal 515.

Figure 6:
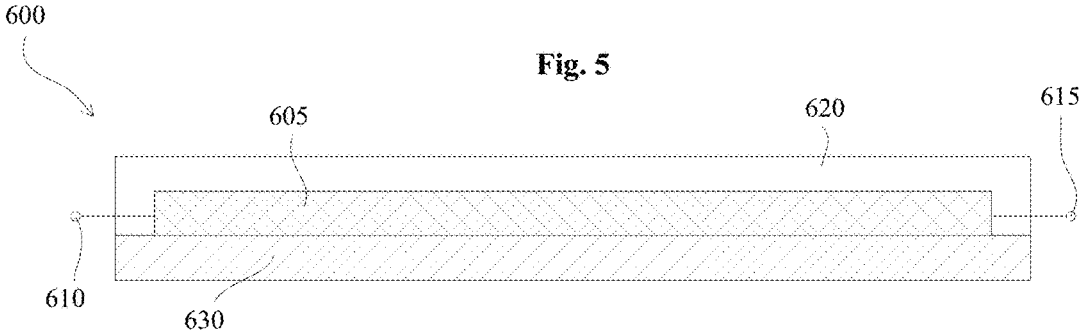
FIG. 6 depicts a profile view of an example nanoparticle composite heater encapsulated within an inert material and a thermally insulating material.

Turning to FIG. 6, an element 600 may include a nanoparticle composite heater 605 encapsulated within an inert material 620 and a thermally insulating material 630. The nanoparticle heater 605 may be similar to, for example, the nanoparticle composite heating elements 22*a-f* of FIG. 2, the nanoparticle composite heating element 300 of FIG. 3, the nanoparticle heater 400 of FIG. 4, or the nanoparticle heater 505 of FIG. 5. The heating element 600 may also include an activation terminal 610 and a negative terminal 615.

The thermally insulating material 630 may be fiberglass, mineral wool, cellulose, polyurethane foam, polystyrene, aerogel (used by NASA for the construction of heat resistant tiles, capable of withstanding heat up to approximately 2000 degrees Fahrenheit with little or no heat transfer), natural fibers (e.g., hemp, sheep's wool, cotton, straw, etc.), polyisocyanurate, or polyurethane.

A heating element 22*a-f*, 300, 400, 500, 600 may include sidewall-functionalized carbon nanotubes. The functionalized carbon nanotubes may include hydroxyl-terminated moieties covalently attached to their sidewalls. Methods of forming the functionalized carbon nanotubes may involve chemistry on carbon nanotubes that have first been fluorinated. In some embodiments, fluorinated carbon nanotubes ("fluoronanotubes") may be reacted with mono-metal salts of a dialcohol, MO—R—OH. M may be a metal and R may be a hydrocarbon or other organic chain and/or ring structural unit. In such embodiments, —O—R—OH may displace —F on the associated nanotube, the fluorine may leave as MF. Generally, such mono-metal salts may be formed in situ by addition of MOH to one or more dialcohols in which the fluoronanotubes have been dispersed. Fluoronanotubes may be reacted with amino alcohols, such as being of the type H2N—R—OH, wherein —N(H)—R—OH displaces —F on the nanotube, the fluorine may leave as HF.

A heating element 22*a-f*, 300, 400, 500, 600 may include carbon nanotubes integrated into an epoxy polymer composite via, for example, chemical functionalization of the carbon nanotubes. Integration of the carbon nanotubes into an epoxy polymer may be enhanced through dispersion and/or covalent bonding with an epoxy matrix during a curing process. In general, attachment of chemical moieties (i.e., functional groups) to a sidewall and/or end-cap of carbon nanotubes such that the chemical moieties may react with either epoxy precursor, a curing agent, or both during the curing process. Additionally, chemical moieties can function to facilitate dispersion of carbon nanotubes with an epoxy matrix by decreasing van der Waals attractive forces between the nanotubes.

A heating element 22*a-f*, 300, 400, 500, 600 may include a carbon nanotube carpet that may include a resistance of a nanotube, and/or the nanotube carpet, of between about 0.1 kΩ and about 10.0 kΩ Instead, the resistance of a nanotube may be between about 2.0 kΩ and about 8.0 kΩ As an another alternative, the resistance of a nanotube may be between about 3.0 kΩ and about 7.0 kΩ A conductive layer/contact may include single or dual damascene copper interconnects, poly-silicon interconnects, silicides, nitrides, and refractory metal interconnects such as, but not limited to, Al, Ti, Ta, Ru, W, Nb, Zr, Hf, Ir, La, Ni, Co, Au, Pt, Rh, Mo, and their combinations. An insulating material or materials may be coated onto individual tubes and/or bundles of tubes (nanotubes) to isolate the tubes and/or bundles from a conductive material. An insulating material may completely cover the tubes and/or bundles. Alternatively, gaps or other discontinuities may be included in the insulating material such that the nanotubes and/or bundles of nanotubes are not completely covered. The insulating material may include polymeric, oxide materials, and/or the like.

A heating element 22*a-f*, 300, 400, 500, 600 may be at least partially formed on a garment by spraying a carbon nanotube/epoxy solution onto a fabric as described herein and within the patents and patent applications that are incorporated herein by reference. The resulting heating element 22*a-f*, 300, 400, 500, 600 may be on an outside of the fabric, an inside surface of the fabric, or may be sandwiched between two or more pieces of fabric.

Although exemplary embodiments of the invention have been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A heated garment, comprising:

a fabric;

a plurality of heating elements, that include nanoparticles, proximate the fabric, wherein the nanoparticles are selected from at least one of: BCN nanotubes, ~BCN nanotubes, ~BC2N nanotubes, boron nitride nanotubes, DNA nanotubes, gallium nitride nanotubes, silicon nanotubes, inorganic nanotubes, tungsten disulphide nanotubes, membrane nanotubes having a tubular membrane connection between cells, titania nanotubes, or tungsten sulfide nanotubes, wherein at least one of the plurality of heating elements is encapsulated within a thermally insulating material on a first surface of the at least one of the plurality of heating elements and an inert material on a second surface and the sides of the at least one of the plurality of heating elements, wherein the inert material is selected from: glass, silicon, or porcelain, and wherein the thermally insulating material is selected from: fiberglass, mineral wool, cellulose, polyurethane foam, polystyrene, aerogel, natural fibers, hemp, sheep's wool, cotton, straw, polyisocyanurate, or polyurethane; and an electronic controller connection for connecting a controller for controlling electrical current flowing through the at least one of the plurality of heating elements, wherein the electronic controller connection includes an activation terminal extending through a first side of the inert material and a negative terminal extending through a second side of the inert material.

2. The heated garment of claim 1, defining a shirt portion that includes a left arm portion having a first heating element associated therewith, the first heating element being arranged on the left arm portion to distribute heat generated by the first heating element throughout the left arm portion; and a right arm portion having a second heating element associated therewith, the second heating element being arranged to distribute heat generated by the second element throughout the right arm portion, wherein the first and second heating elements are connected in series.

3. The heated garment of claim 2, wherein the shirt portion comprises a front torso portion having a third heating element and a rear torso portions having a fourth heating element associated therewith, wherein the third and fourth heating elements are connected in series.

4. The heated garment of claim 1, further comprising:

a shunt resistor electrically connected in series with at least one of the plurality of heating elements, wherein the shunt resistor is configured to provide a signal to a current limiting circuit.

5. The heated garment of claim 4, wherein the fabric is divided into and defines a plurality of independent heating zones; wherein each of the plurality of heating elements is associated with a single such heating zone to thereby heat independently a particular heating zone of the heated garment, wherein the current limiting circuit is configured to limit an individual current to each of the plurality of heating elements, and wherein the current limiting circuit is further configured to limit a total current to all of the plurality of heating elements combined.

6. The heated garment of claim 1, further comprising:

a second power level selection which includes a manually operable power level selection device to control the controller to increase or decrease current flow through each of the plurality of heating elements.

7. A heated garment as in claim 1, further comprising:

at least an upper body garment portion having at least first and second independent heating zones; and at least two independent heating elements respectively associated with each such independent heating zone of a respective garment portion, each heating element being operable to generate heat in response to a current flowing therethrough.

8. The heated garment of claim 7, further comprising:

a plurality of power level selection devices, each such power level selection device being independently associated with one such independent heating element, and operable to control current flowing.

9. A heated garment, comprising:

a fabric;

a conductor including at least one of a plurality of heating elements that includes nanoparticles for generating heat in response to a current flow therethrough, and for distributing heat throughout the fabric, wherein the nanoparticles are selected from at least one of: BCN nanotubes, ~BCN nanotubes, ~BC2N nanotubes, boron nitride nanotubes, DNA nanotubes, gallium nitride nanotubes, silicon nanotubes, inorganic nanotubes, tungsten disulphide nanotubes, membrane nanotubes having a tubular membrane connection between cells, titania nanotubes, or tungsten sulfide nanotubes, wherein the at least one of the plurality of heating elements is encapsulated within a thermally insulating material on a first surface of the at least one of the plurality of heating elements and an inert material on a second surface and the sides of the at least one of the plurality of heating elements, wherein the inert material is selected from: glass, silicon, or porcelain, and wherein the thermally insulating material is selected from: fiberglass, mineral wool, cellulose, polyurethane foam, polystyrene, aerogel, natural fibers, hemp, sheep's wool, cotton, straw, polyisocyanurate, or polyurethane;

a controller for controlling in pulse width modulated fashion the current flow through the carbon nanotubes, the controller further being secured to a portion of the garment;

power level selection for providing manual control over the controller;

a flexible wiring harness having first and second ends; and an electrical connector securely mounted to a portion of the fabric for removably connecting the second end of the wiring harness with an activation terminal extending through a first side of the inert material and the first end of the wiring harness with a negative terminal extending through a second side of the inert material.

10. The heated garment of claim 9, wherein the fabric includes at least one of; polyethylene terephthalate fibers, or spandex fibers.

11. The heated garment of claim 9, wherein the controller comprises:

an analog control signal operable to control current flowing through the conductor in accordance with a first power level adjustment; and a digital control signal for further control of the current flowing through the conductor.

12. The heated garment of claim 9, wherein the fabric defines a plurality of independent heating zones of the heated garment, wherein the conductor comprises a plurality of electrical conductors, each such conductor being independently associated with a particular such heating zone of the heated garment, and wherein the power level selection comprises a plurality of first power level selection devices and a second power level selection device, each such first power level selection device being independently associated with a particular such electrical conductor and operable to provide manual control of the current flow through its associated electrical conductor.

13. The heated garment of claim 9, further comprising:

a shunt resistor electrically connected in series with the at least one heating element, wherein the shunt resistor is configured to provide a signal to a current limiting circuit.

14. The heated garment of claim 9, wherein the fabric comprises:

an independent shirt portion having an independent torso portion and independent sleeve portions, the torso portion being independently associated with at least one such electrical conductor, and the sleeve portions being independently associated with at least one such electrical conductor.

15. The heated garment of claim 9, wherein the conductor comprises a plurality of independent electrical conductors, and wherein the electrical connector comprises a plurality of electrical connectors, each such connector being independently associated with a particular such conductor and operable to interrupt current flowing through its associated conductor when such current exceeds a predetermined level.

16. The heated garment of claim 15, wherein each electrical connector further comprises a removable fuse for interrupting current flowing through its associated conductor when such current exceeds a predetermined level.

17. An electrically heated wearable garment, comprising:

a fabric;

at least one of a plurality of heating elements including nanoparticles, wherein the nanoparticles are selected from at least one of: BCN nanotubes, ~BCN nanotubes, ~BC2N nanotubes, boron nitride nanotubes, DNA nanotubes, gallium nitride nanotubes, silicon nanotubes, inorganic nanotubes, tungsten disulphide nanotubes, membrane nanotubes having a tubular membrane connection between cells, titania nanotubes, or tungsten sulfide nanotubes, wherein the at least one of the plurality of heating elements is encapsulated within a thermally insulating material on a first surface of the at least one of the plurality of heating elements and an inert material on a second surface and the sides of the at least one of the plurality of heating elements, wherein the inert material is selected from: glass, silicon, or porcelain, and wherein the thermally insulating material is selected from: fiberglass, mineral wool, cellulose, polyurethane foam, polystyrene, aerogel, natural fibers, hemp, sheep's wool, cotton, straw, polyisocyanurate, or polyurethane; and a controller connection for connecting a controller for controlling electric current flowing through the at least one heating element, wherein the controller connection includes an activation terminal extending through a first side of the inert material and a negative terminal extending through a second side of the inert material.

18. The electrically heated wearable garment of claim 17, wherein the fabric includes at least one of; polyethylene terephthalate fibers, or spandex fibers.

19. The electrically heated wearable garment of claim 17, further comprising:

a shunt resistor electrically connected in series with the at least one heating element, wherein the shunt resistor is configured to provide a signal to a current limiting circuit.

20. The electrically heated wearable garment of claim 17, further comprising a removable connector assembly having at least one wing portion, the connector assembly being operable to connect a conductor with the controller and a wing portion being operable to help facilitate attachment of the fabric.

* * * * *